US011222581B2

(12) United States Patent
Yuan et al.

(10) Patent No.: US 11,222,581 B2
(45) Date of Patent: Jan. 11, 2022

(54) PIXEL CIRCUIT AND DRIVING METHOD THEREOF, DISPLAY PANEL AND DISPLAY APPARATUS

(71) Applicant: XIAMEN TIANMA MICRO-ELECTRONICS CO., LTD., Xiamen (CN)

(72) Inventors: Yong Yuan, Shanghai (CN); Yuheng Zhang, Xiamen (CN); Wanming Huang, Xiamen (CN); Jieliang Li, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 99 days.

(21) Appl. No.: 16/442,812

(22) Filed: Jun. 17, 2019

(65) Prior Publication Data

US 2020/0312223 A1 Oct. 1, 2020

(30) Foreign Application Priority Data

Mar. 28, 2019 (CN) ..... 201910243764.6

(51) Int. Cl.
*G09G 3/32* (2016.01)

(52) U.S. Cl.
CPC ..... *G09G 3/32* (2013.01); *G09G 2300/0809* (2013.01); *G09G 2320/0233* (2013.01); *G09G 2320/0257* (2013.01); *G09G 2330/028* (2013.01)

(58) Field of Classification Search
CPC combination set(s) only.
See application file for complete search history.

(56) References Cited

U.S. PATENT DOCUMENTS

2016/0111484 A1* 4/2016 An ..... G09G 3/3266 257/72
2017/0162115 A1* 6/2017 Chen ..... G09G 3/3233
2017/0221418 A1* 8/2017 Xiang ..... G09G 3/3233
2018/0130420 A1* 5/2018 Gao ..... H01L 51/5206
(Continued)

FOREIGN PATENT DOCUMENTS

CN 103187024 A 7/2013
CN 107342044 A 11/2017
(Continued)

*Primary Examiner* — William Boddie
*Assistant Examiner* — Alecia D English
(74) *Attorney, Agent, or Firm* — Anova Law Group, PLLC

(57) ABSTRACT

A pixel circuit, a method for driving a pixel circuit and a display panel are provided. An exemplary pixel circuit includes a data writing module and a driving transistor, a voltage of a first terminal of the driving transistor being greater than a voltage of a second terminal; a light-emitting control module and a light-emitting device, the light-emitting device being configured to emit light in response to the driving current generated by the driving transistor; a first initialization module and a second initialization module; and a reset module configured to cause the voltage of the second terminal of the driving transistor to be greater than or equal to the voltage of the first terminal of the driving transistor in response to a current-stage reset signal, an enable signal of the current-stage reset signal appearing after an enable signal of the current-stage light-emitting signal.

20 Claims, 8 Drawing Sheets

(56) References Cited

U.S. PATENT DOCUMENTS

| | | | | |
|---|---|---|---|---|
| 2018/0166025 | A1* | 6/2018 | Zhou | G09G 3/3233 |
| 2020/0184893 | A1* | 6/2020 | Dong | G09G 3/3225 |

FOREIGN PATENT DOCUMENTS

| | | | |
|---|---|---|---|
| CN | 107610651 | A | 1/2018 |
| CN | 107833559 | A | 3/2018 |
| CN | 109064975 | A | 12/2018 |

* cited by examiner

PIXEL CIRCUIT AND DRIVING METHOD THEREOF, DISPLAY PANEL AND DISPLAY APPARATUS

CROSS-REFERENCES TO RELATED APPLICATIONS

This application claims priority of Chinese Patent Application No. 201910243764.6, filed on Mar. 28, 2019, the entire contents of which are hereby incorporated by reference.

FIELD OF THE DISCLOSURE

The present disclosure generally relates to the field of display technology and, more particularly, relates to a pixel circuit, a method for driving a pixel circuit, a display panel, and a display apparatus.

BACKGROUND

In recent years, display technology has been developed rapidly, and the types of display panels have become more and more abundant. Various types of display panels including liquid crystal display (LCD) panels, organic light-emitting display (OLED) panels, electronic paper display panels, micro-diode display panels, and sub-millimeter LED display panels have been developed.

The micro-diode display panel or the sub-millimeter LED display panel includes a pixel array; and the pixel array includes a plurality of pixels. In the plurality of pixels, micro-diodes or sub-millimeter LEDs are used as light-emitting devices. The display panel also includes pixel circuits for driving the light-emitting devices to emit light.

In the micro-diode display panel or the sub-millimeter LED display panel, the driving current of the pixel circuit needs to be in the order of several tens of milli-amperes, and the driving current is substantially large, which causes the temperature of the driving transistors in the pixel circuit to rise. Further, a large number of electrons in the driving transistors are directionally moved and accumulated for a long time, which affects the stability of the driving transistors, and easily causes the characteristics of the driving transistors to drift, and the characteristic shift degrees of different driving transistors are different, and problems, such as displaying "mura" and residual image, may occur. Accordingly, the display quality is reduced.

Therefore, there is a need to improve the stability of the driving transistors in the pixel circuit. The disclosed pixel circuit and driving method are directed to solve one or more problems set forth above and other problems in the art.

BRIEF SUMMARY OF THE DISCLOSURE

One aspect of the present disclosure provides a pixel circuit. The pixel circuit may include a data writing module, a driving transistor, a light-emitting control module, a light-emitting device, a first initialization module, a second initialization module, and a reset module. The data writing module is configured to transmit a data signal voltage to the driving transistor in response to a current-stage scan signal; the driving transistor is configured to generates a driving current according to the data signal voltage transmitted from the data writing module a voltage of a first terminal of the driving transistor is greater than a voltage of a second terminal of the driving transistor; the light-emitting control module is coupled between a first power source voltage signal terminal and a first terminal of the light-emitting device and configured to provide a driving current to the light-emitting device through the driving transistor in response to a current-stage light-emitting signal; the light-emitting device is configured to emit light in response to the driving current generated by the driving transistor; the first initialization module is electrically connected to a gate of the driving transistor and configured to provide a first initialization voltage to the gate of the driving transistor in response to a previous-stage scan signal; the second initialization module is electrically connected to the first terminal of the light-emitting device and configured to provide a second initialization voltage to the first terminal of the light-emitting device; the reset module is configured to cause a voltage of the second terminal of the driving transistor to be greater than or equal to a voltage of the first terminal of the driving transistor in response to a current-stage reset signal; and an enable signal of the current-stage reset signal appears after an enable signal of the current-stage light-emitting signal.

Another aspect of the present disclosure provides a method of for driving a pixel circuit. The method may include providing a disclosed pixel circuit. The method may also include turning on the first initialization module to write the current-stage reset signal to the gate of the driving transistor during an initialization stage; turning on the data writing module to transmit a data signal voltage to the driving transistor during a data writing stage; turning on the light-emitting control module to provide the driving current to the light-emitting device through the driving transistor and to drive the light-emitting device to emit light during a light-emitting stage; and turning on the reset module to cause a voltage of the second terminal of the driving transistor to be greater than or equal to a voltage of the first terminal of the driving transistor. The second initialization module is turned on in response to an enable signal of the previous-stage scan signal during the initialization stage or to write a second initialization voltage to a first terminal of the light-emitting device. During the initialization stage, the previous-stage scan signal is an enable signal, the current-stage scan signal is a non-enable signal, the current-stage light-emitting signal is a non-enable signal, and the current-stage reset signal is a non-enable signal. During the data writing stage, the previous-stage scan signal is a non-enable signal, the current-stage scan signal is an enable signal, the current-stage light-emitting signal is a non-enable signal, and the current-stage reset signal is a non-enable signal. During the light-emitting stage, the previous-stage scan signal is an enable signal, the current-stage scan signal is a non-enable signal, the current-stage light-emitting signal is an enable signal, and the current-stage reset signal is a non-enable signal. During the reset stage, the previous-stage scan signal is a non-enable signal, the current-stage scan signal is a non-enable signal, the current-stage light-emitting signal is a non-enable signal, and the current-stage reset signal is an enable signal.

Another aspect of the present disclosure provides a display panel. The display panel may include a plurality of disclosed pixel circuits.

Another aspect of the present disclosure provides a display apparatus. The display apparatus may include a disclosed display panel. The display panel may include a plurality of disclosed pixel circuits.

Other aspects of the present disclosure can be understood by those skilled in the art in light of the description, the claims, and the drawings of the present disclosure.

BRIEF DESCRIPTION OF THE DRAWINGS

The following drawings are incorporated in and constitute a part of the specification, illustrating embodiments of the present disclosure, and together with the detailed descriptions serve to explain the mechanism of the present disclosure.

DETAILED DESCRIPTION

Figure 1:
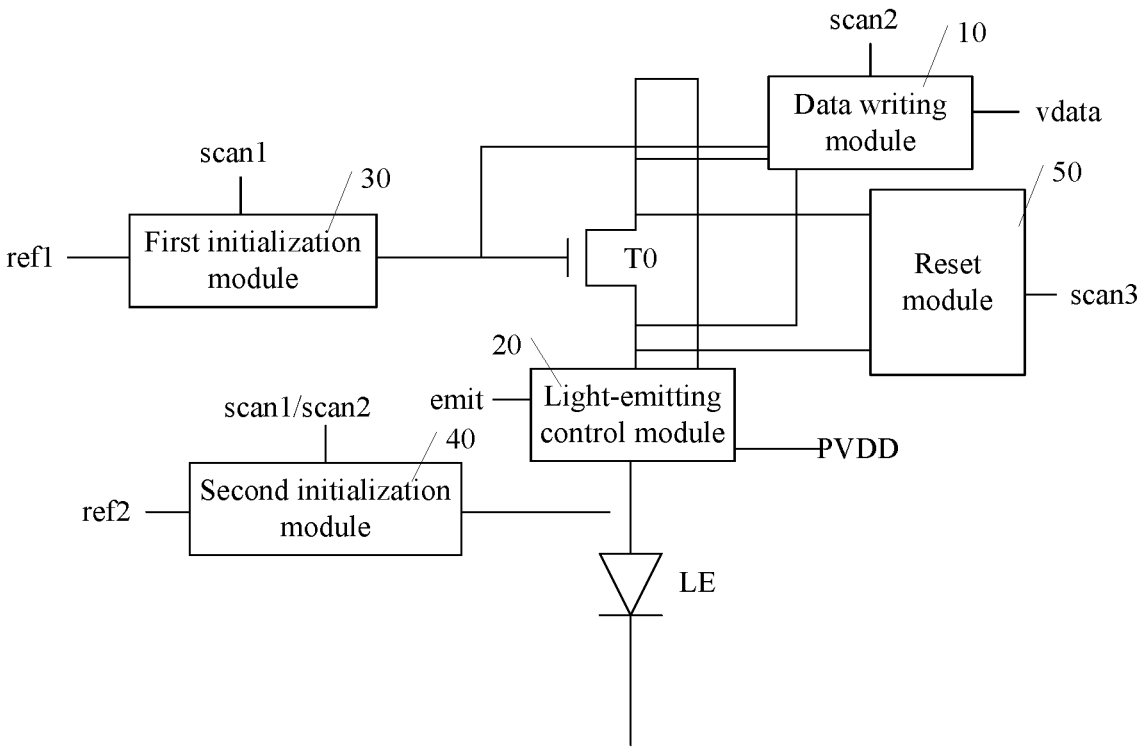
FIG. 1 illustrates an exemplary pixel circuit consistent with various disclosed embodiments.

Reference will now be made in detail to exemplary embodiments of the disclosure, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all the embodiments of the present disclosure. Based on the disclosed embodiments, persons of ordinary skill in the art may derive other embodiments consistent with the present disclosure, all of which are within the scope of the present disclosure. Further, in the present disclosure, the disclosed embodiments and the features of the disclosed embodiments may be combined when there are no conflicts.

Certain techniques, methods, and apparatus that are understandable to the persons of ordinary skill in the art may not be described in detail. However, under appropriate conditions, such techniques, methods and apparatus are also included as the parts of the description.

In the disclosed embodiments, specific values may be explained for illustrative purposes and might not be used as limitations. Thus, embodiments may have different specific values.

Further, the similar symbols and letters in the drawings may denote similar elements. Thus, once one element is defined in one drawing, it may not need to be defined in the following drawings.

FIG. 1 illustrates an exemplary pixel circuit consistent with various disclosed embodiments. As shown in FIG. 1, the pixel circuit may include a data writing module 10 and a driving transistor T0. The data wiring module 10 may be configured to transmit the data signal voltage "vdata" to the driving transistor T0 in response to a current-stage scan signal "scan2". The driving transistor T0 may be configured to generate a driving current according to the data signal voltage "vdata" transmitted through the data writing module 10. When the driving transistor T0 generates a driving current, the voltage of the first terminal of the driving transistor T0 may be greater than the voltage of the second terminal of the driving transistor T0.

Further, the pixel circuit may include a light-emitting control module 20 and a light-emitting device LE. The light-emitting control module 20 may be coupled in series between a first power source voltage signal line "PVDD" and the first terminal of the light-emitting device LE, and may be configured to provide a driving current to the light-emitting device LE through the driving transistor T0 in response to a current-stage light-emitting signal "emit".

The light-emitting device LE may be used to emit light in response to the driving current generated by the driving transistor T0;

Further, the pixel circuit may include a first initialization module 30 electrically connected to the gate of the driving transistor T0; and configured to provide a first initialization voltage "ref1" to the gate of the driving transistor T0 in response to the previous-stage scan signal "scan1".

Further, the pixel circuit may include a second initialization module 40 electrically connected to the first terminal of the light-emitting device LE; and configured to provide a second initialization voltage "ref2" to the first terminal of the light-emitting device LE in response to the previous-stage scan signal "scan1" or the current-stage scan signal "scan2".

Further, the pixel circuit may include a reset module 50 configured to respond to a current-stage reset signal "scan3" to cause the voltage of the second terminal of the driving transistor T0 to be greater than or equal to the voltage of the first terminal of the driving transistor T0, and the enable signal of the current-stage reset signal "scan3" may appear after the enable signal of the current-stage lighting-emitting signal.

In the pixel circuit, the first initialization module 30 and the second initialization module 40 may be included. The first initialization module 30 may be used to initialize the gate of the driving transistor T0; and the second initialization module 40 may be used to initialize the first terminal of the light-emitting device LE.

The driving transistor T0 may be used to generate a driving current to drive the light-emitting device LE to emit light. When the driving transistor T0 generates a driving current, the voltage of the first terminal of the drive transistor T0 may be greater than the voltage of the second terminal of the driving transistor T0. Under such a condition, in the driving transistor T0, electrons may move from the second terminal to the first terminal.

To prevent electrons of the driving transistor T0 from accumulating after a long period of time movement to cause the characteristics of the driving transistor T0 to drift, in one embodiment, the reset module 50 is disposed in the pixel circuit. Further, the enable signal of the current-stage reset signal "scan3" may appear after the enable signal of the current-stage light-emitting signal. In another word, after the enable signal of the light-emitting signal controls the light-emitting device LE to emit light, the enable signal of the reset signal "scan3" may control the reset module 50 to be in operation. The reset module 50 may cause the voltage of the second terminal of the driving transistor T0 to be greater than or equal to the voltage of the first terminal of the driving transistor T0 in response to the enable signal of the current-stage reset signal "scan3".

In particular, when the voltage of the second terminal of the driving transistor T0 is greater than the voltage of the first terminal of the driving transistor T0, the electrons in the driving transistor T0 may move from the first terminal to the second terminal, the moving direction of the electrons may be opposite to the moving direction of the electrons of the driving current generated by the driving transistor T0. Thus, the characteristics of the driving transistor T0 may be shifted in an opposite direction. Thus, the characteristic drift of the driving transistor T0 may be opposite.

When the voltage of the second terminal of the driving transistor T0 is equal to the voltage of the first terminal of the driving transistor T0, there may be no voltage difference between the first terminal and the second terminal of the driving transistor T0. Thus, there may be no current flow. During the working period of the reset module 50, the driving transistor T0 may be no longer at a bias state. Thus, the problems, such as the characteristic drift and the heat generation of the driving transistor T0, may be reduced.

The driving transistor T0 may be an N-type transistor or a P-type transistor. The type of the driving transistor T0 may not be specifically limited by the present disclosure.

In one embodiment, the first terminal of the driving transistor T0 may be configured as a source and the second terminal may be configured as a drain according to the type of the transistor and the signal applied on the gate. In some embodiments, the first terminal of the driving transistor may be configured as a drain and the second terminal may be configured as a source.

In the pixel circuit, the specific structure of the reset module 50 may be various. For illustrative purposes, the exemplary structure of the reset module 50 may be described as following.

In one embodiment, as shown in FIG. 1, the reset module 50 may be configured to electrically connect the second terminal of the driving transistor T0 to the first terminal of the driving transistor T0 in response to the current-stage reset signal "scan3" to allow the voltage of the second terminal to be equal to the voltage of the first terminal of the driving transistor T0.

Figure 2:
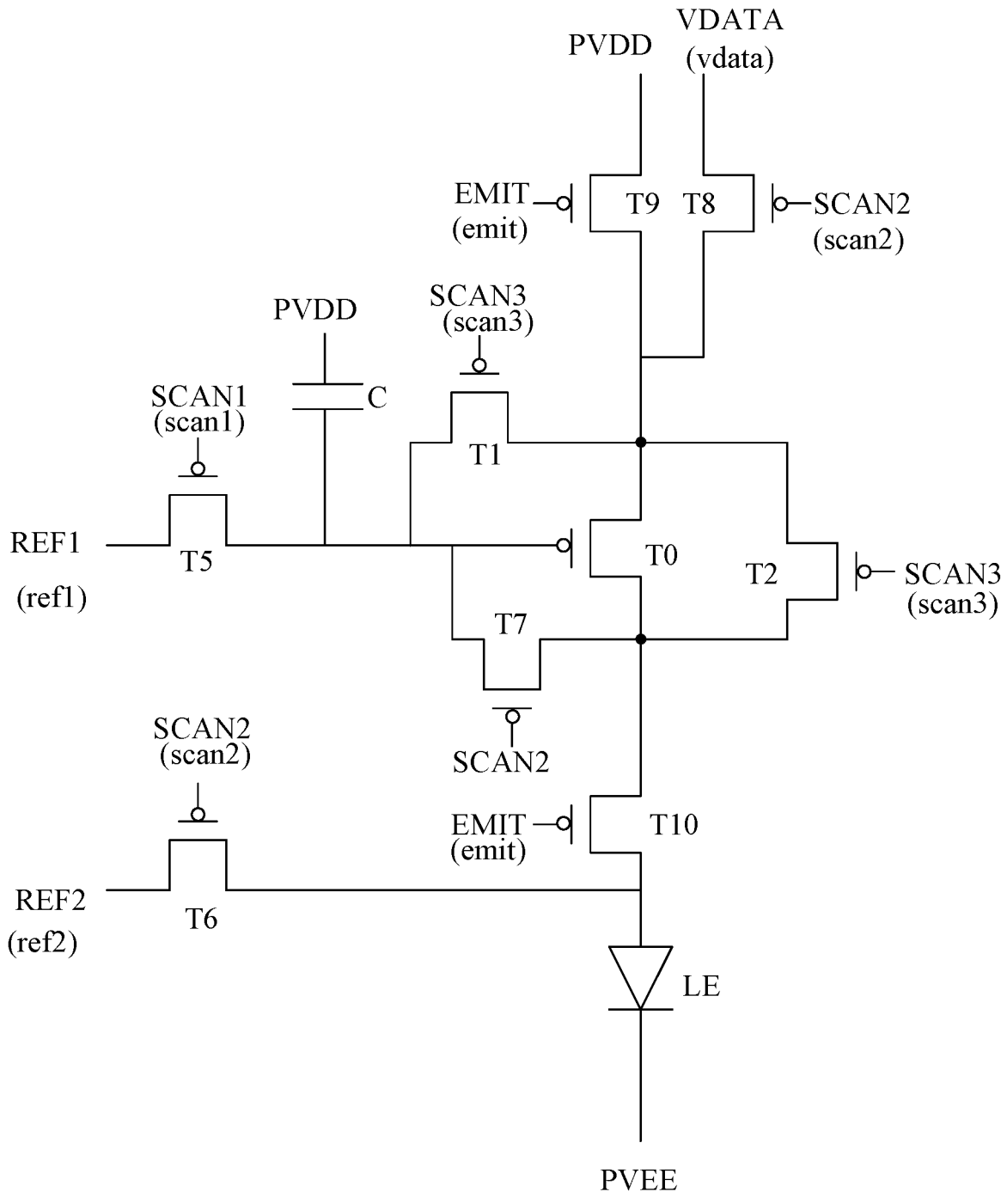
FIG. 2 illustrates another exemplary pixel circuit consistent with various disclosed embodiments.
Figure 3:
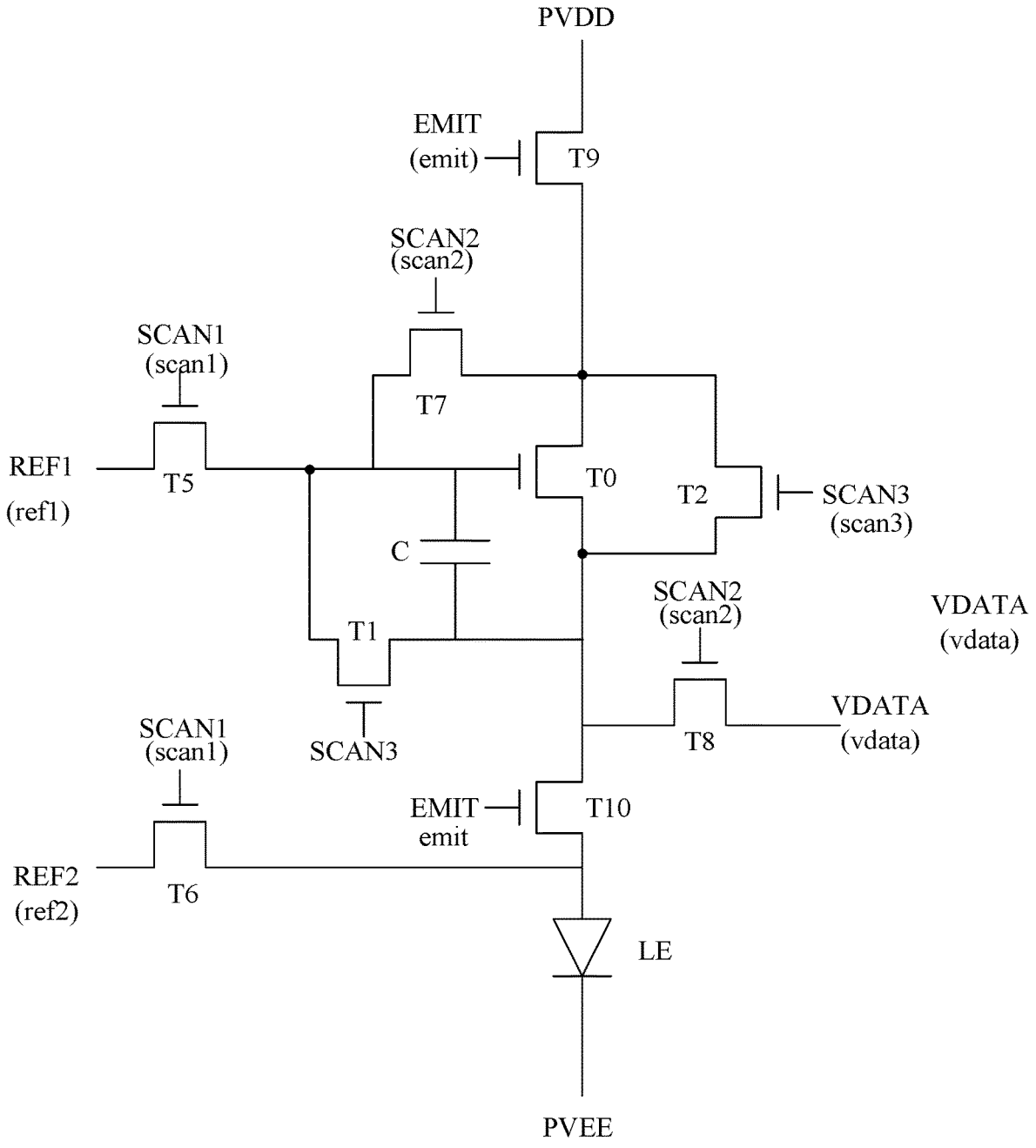
FIG. 3 illustrates another exemplary pixel circuit consistent with various disclosed embodiments.

The specific structure of the reset module 50 may be referred to FIG. 1, FIG. 2, and FIG. 3. FIG. 2 illustrates another exemplary pixel circuit consistent with various disclosed embodiments; and FIG. 3 illustrates another exemplary pixel circuit consistent with various disclosed embodiments.

In one embodiment, the reset module 50 may include a first transistor T1 and a second transistor T2.

As shown in FIG. 2, when the driving transistor T0 is a P-type transistor, the gate of the first transistor T1 and the third control signal terminal "SCAN3" may be electrically connected; the first terminal of the first transistor T1 and the gate of the driving transistor T0 may be electrically connected; and the second terminal of the first transistor T1 and the first terminal of the driving transistor T0 may be electrically connected. Further, the gate of the second transistor T2 may be electrically connected to the third control signal terminal "SCAN3"; the first terminal of the second transistor T2 may be electrically connected to the first terminal of the driving transistor T0; and the second terminal of the second transistor T2 may be electrically connected to the second terminal of the driving transistor T0.

As shown in FIG. 3, when the driving transistor T0 is an N-type transistor, the gate of the first transistor T1 and the third control signal terminal "SCAN3" may be electrically connected; the first terminal of the first transistor T1 and the gate of the driving transistor T0 may be electrically connected; and the second terminal of the first transistor T1 and the second terminal of the driving the transistor T0 may be electrically connected. Further, the gate of the second transistor T2 may be electrically connected to the third control signal terminal "SCAN3"; the first terminal of the second transistor T2 may be electrically connected to the first terminal of the driving transistor T0; and the second terminal of the second transistor T2 may be electrically connected to the second terminal of the driving transistor T0.

The current-stage reset signal "scan3" may be transmitted to the gate of the first transistor T1 and the gate of the second transistor T2, respectively, through the third control signal terminal "SCAN3".

In the pixel circuit, the first transistor T1 and the second transistor T2 may be disposed in the reset module 50, and the second terminal of the driving transistor T0 and the first terminal of the driving transistor T0 may be electrically connected through the first transistor T1 and the second transistor T2. Thus, the voltage of the second terminal of the driving transistor T0 may be equal to the voltage of the first terminal of the driving transistor T0. During the time for the reset module 50 in operation, the driving transistor T0 may be no longer at a bias state. Thus, the problems, such as characteristic drift and heat generation, etc., of the driving transistor T0 may be reduced.

Figure 4:
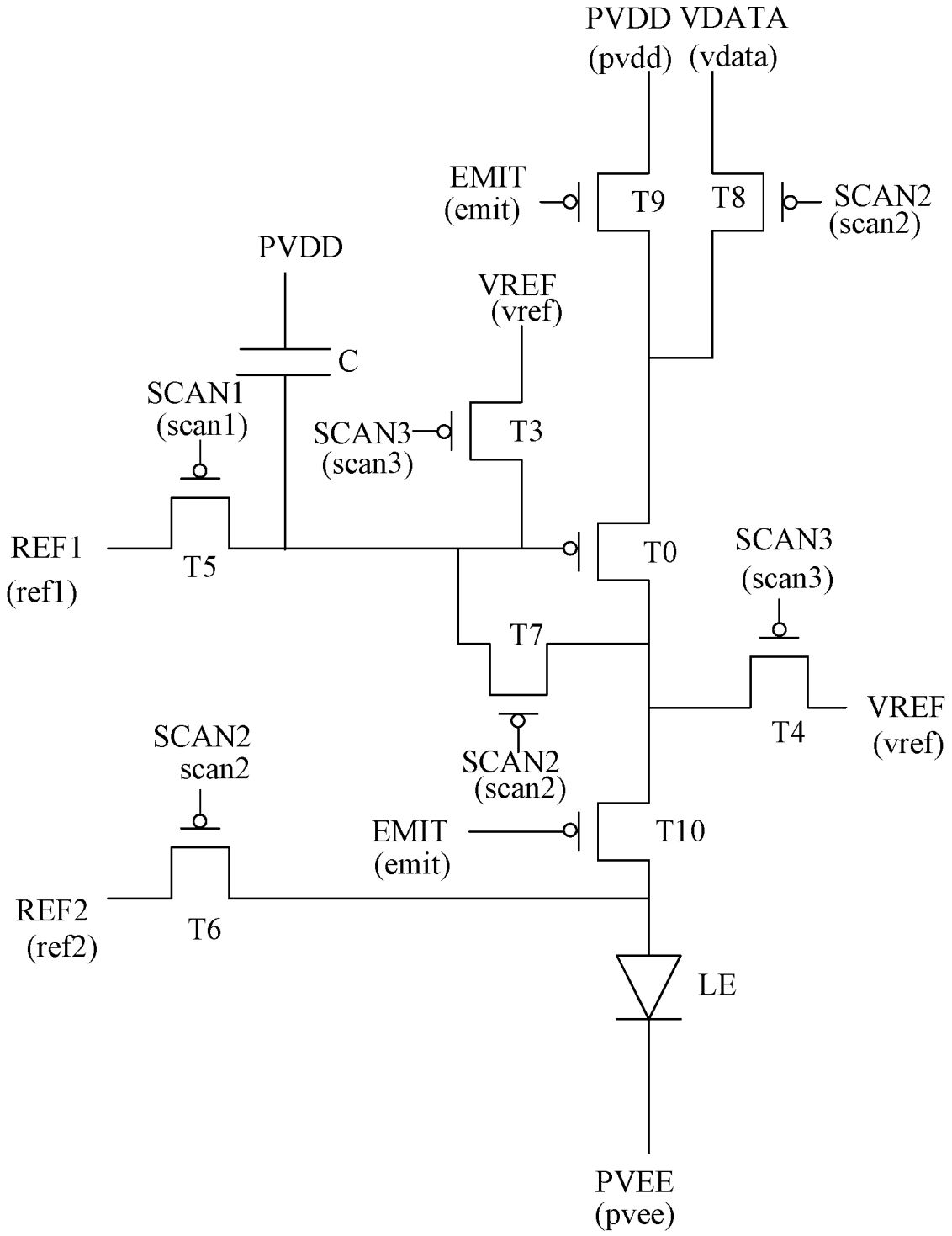
FIG. 4 illustrates another exemplary pixel circuit consistent with various disclosed embodiments.

In another embodiment, the reset module 50 may be configured to cause the voltage of the second terminal of the driving transistor T0 to be greater than the voltage of the first terminal of the driving transistor T0 in response to the current-stage reset signal "scan3". The specific structure of the reset module 50 may be referred to FIG. 1, FIG. 4, and FIG. 5. FIG. 4 illustrates another exemplary pixel circuit consistent with various disclosed embodiments; and FIG. 5 illustrates another exemplary pixel circuit consistent with various disclosed embodiments.

Figure 5:
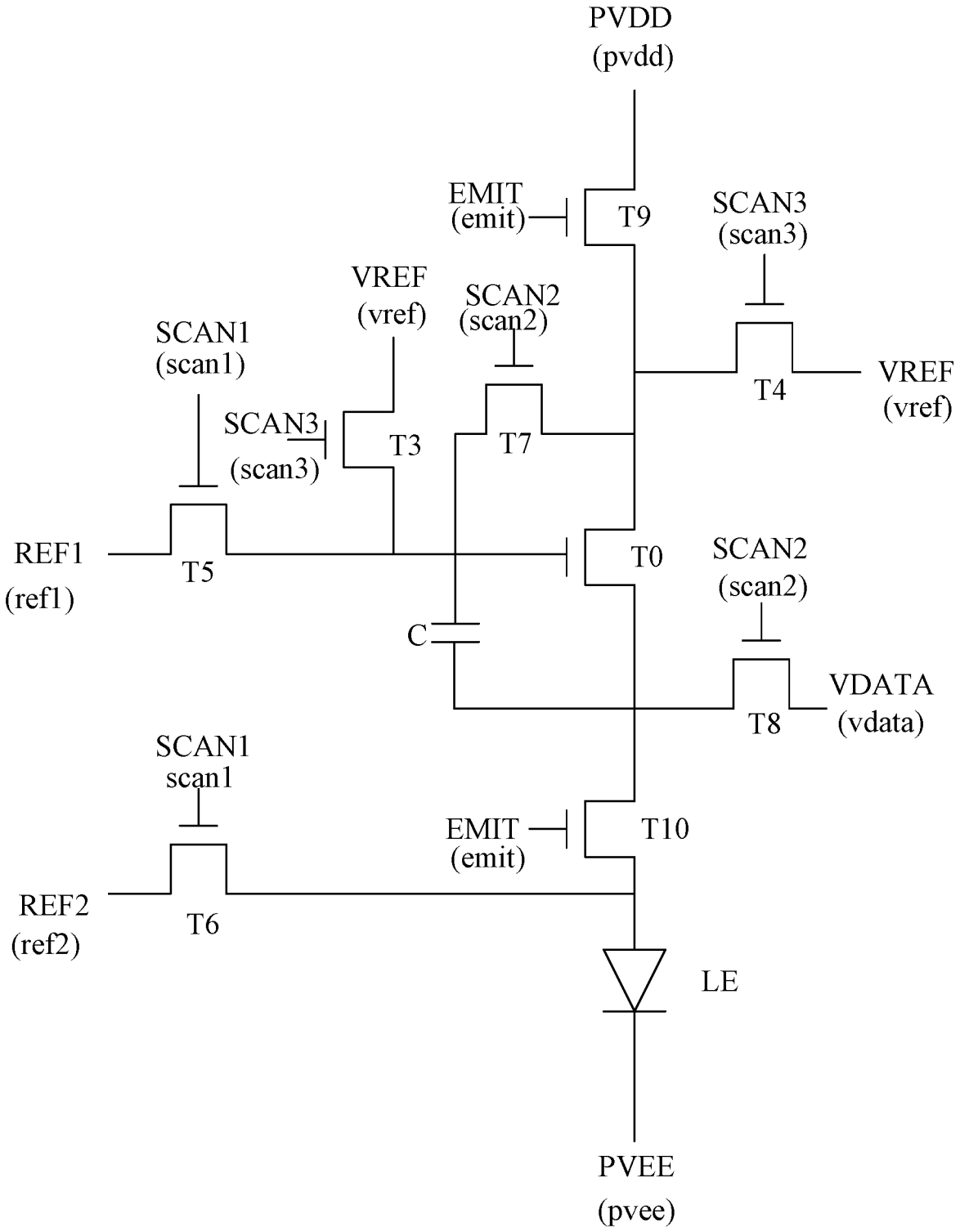
FIG. 5 illustrates another exemplary pixel circuit consistent with various disclosed embodiments.

As shown in FIG. 1, FIG. 4 and FIG. 5, the reset module 50 may include a third transistor T3 and a fourth transistor T4. The gate of the third transistor T3 may be electrically connected to the third control signal terminal "SCAN3"; the first terminal of the third transistor T3 and the reset voltage terminal "VREF" may be electrically connected; and the second terminal of the third transistor T3 may be electrically connected to the gate of the driving transistor T0.

When the driving transistor T0 is a P-type transistor, the gate of the fourth transistor T4 may be electrically connected to the third control signal terminal "SCAN3"; the first terminal of the fourth transistor T4 and the reset voltage terminal "VREF" may be electrically connected, and the second terminal of the fourth transistor T4 and the second terminal of the driving transistor T0 may be electrically connected. The reset voltage "vref" of the reset voltage terminal "VREF" may be greater than the voltage of the first terminal of the driving transistor T0.

When the driving transistor T0 is an N-type transistor, the gate of the fourth transistor T4 may be electrically connected to the third control signal terminal "SCAN3"; the first terminal of the fourth transistor T4 and the reset voltage terminal "VREF" may be electrically connected; and the second terminal of the fourth transistor T4 and the first terminal of the driving transistor T0 may be electrically connected. The reset voltage "vref" of the reset voltage terminal "VREF" may be smaller than the voltage of the second terminal of the driving transistor T0.

The current-stage reset signal "scan3" may be transmitted to the gate of the third transistor T3 and the gate of the fourth transistor T4, respectively, through the third control signal terminal "SCAN3". In one embodiment, the reset module 50 may include the third transistor T3 and the fourth transistor T4. During the time period for the reset module 50 in operation, the third transistor T3 may be configured to supply a reset voltage "vref" to the gate of the driving transistor T0. When the driving transistor T0 is a P-type transistor, the fourth transistor T4 may be configured to supply the reset voltage "vref" to the second terminal of the driving transistor T0. When the driving transistor T0 is an N-type transistor, the fourth transistor T4 may be configured to supply the reset voltage "vref" to the first terminal of the driving transistor T0.

In some embodiments, referring to FIG. 1, FIG. 4 and FIG. 5, the first terminal of the driving transistor T0 may be configured to receive the first power source voltage "pvdd" transmitted by the first power source voltage signal line "PVDD".

When the driving transistor T0 is a P-type transistor, the reset voltage "vref" may be greater than the first power source voltage "pvdd". Thus, the voltage of the second terminal of the driving transistor T0 may be greater than the voltage of the first terminal of the driving transistor T0.

When the driving transistor T0 is an N-type transistor, the reset voltage of the reset voltage terminal "VREF" may be equal to the voltage of the second terminal "pvee" of the light-emitting device LE. Thus, the voltage of the second terminal of the driving transistor T0 may be greater than the voltage of the first terminal of the driving transistor T0. The voltage of the second terminal "pvee" of the light-emitting device LE may be provided by the second power source voltage signal line "PVEE".

In the above embodiments, only the specific structure of the reset module is exemplarily described, the specific implementation of the reset module may also be various, as long as the reset module may satisfy: in response to the current-stage reset signal "scan3", the voltage of the second terminal of the driving transistor T0 being greater than or equal to the voltage of the first terminal of the driving transistor T0, and the enable signal of the current-stage reset signal "scan3" appearing after the enable signal of the current-stage light-emitting signal, which is within the protection scope of the present disclosure.

In the following, the structures of other modules of the pixel circuit are described.

In one embodiment, referring to FIG. 1 and FIG. 2 to FIG. 5, the first initialization module 30 may include a fifth transistor T5. The gate of the fifth transistor T5 may be electrically connected to the first control signal terminal "SCAN1". The first terminal of the fifth transistor T5 may be electrically connected to the first initialization voltage terminal "REF1"; and the second terminal of the fifth transistor T5 may be electrically connected to the gate of the driving transistor T0. The previous-stage scan signal "scan1" may be transmitted to the gate of the fifth transistor T5 through the first control signal terminal "SCAN1".

In one embodiment, the first initialization voltage terminal "REF1" may be used to provide a first initialization voltage "ref1" to initialize the gate of the driving transistor T0.

Further, in one embodiment, referring to FIG. 1 and FIG. 2 to FIG. 5, the second initialization module 40 may include a sixth transistor T6. The gate of the sixth transistor T6 may be electrically connected to the first control signal terminal "SCAN1" (referring to FIG. 3 or FIG. 5) or to the second control signal terminal "SCAN2" (referring to FIG. 2 or FIG. 4); the first terminal of the sixth transistor T6 may be electrically connected to the second initialization voltage terminal "REF2". The second terminal of the sixth transistor T6 may be electrically connected to the first terminal of the light-emitting device LE.

The previous-stage scan signal "scan1" may be transmitted to the gate of the sixth transistor T6 through the first control signal terminal "SCAN1" connected to the gate of the sixth transistor T6. In some embodiments, the current-stage scan signal "scan2" may be transmitted to the gate of the sixth transistor T6 through the second control signal terminal "SCAN2" connected to the gate of the sixth transistor T6.

In one embodiment, the second initialization voltage terminal "REF2" may be used to provide the second initialization voltage "ref2" to initialize the first terminal of the light-emitting device LE.

When the driving transistor T0 is a P-type transistor, the signal of the first initialization voltage terminal "REF1" and the signal of the second initialization voltage terminal "REF2" may be the same. In particular, the signal of the first initialization voltage "ref1" and the signal of the second initialization voltage "ref2" may be the same.

Further, referring to FIG. 1 and FIG. 2-FIG. 5, the data writing module 10 may include a seventh transistor T7 and an eighth transistor T8.

When the driving transistor T0 is a P-type transistor, the gate of the seventh transistor T7 may be electrically connected to the second control signal terminal "SCAN2"; the first terminal of the seventh transistor T7 and the gate of the driving transistor T0 may be electrically connected; and the second terminal of the seventh transistor T7 and the second terminal of the driving transistor T0 may be electrically connected. Further, the gate of the eighth transistor T8 may be electrically connected to the second control signal terminal "SCAN2". The first terminal of the eighth transistor T8 may be electrically connected to the data signal line "VDATA"; and the second terminal of the eighth transistor T8 may be electrically connected to the first terminal of the driving transistor T0.

When the driving transistor T0 is an N-type transistor, the gate of the seventh transistor T7 may be electrically connected to the second control signal terminal "SCAN2"; the first terminal of the seventh transistor T7 may be electrically connected to the gate of the driving transistor T0; and the second terminal of the seventh transistor T7 may be electrically connected to the first terminal of the driving transistor T0. Further, the gate of the eighth transistor T8 may be electrically connected to the second control signal terminal "SCAN2"; the first terminal of eighth transistor T8 may be electrically connected to the data signal line "VDATA"; and the second terminal of the eighth transistor T8 may be electrically connected to the second terminal of the driving transistor T0.

The current scan signal "scan2" may be transmitted to the gate of the seventh transistor T7 and the gate of the eighth transistor T8 through the second control signal terminal "SCAN2", respectively.

In one embodiment, the data writing module 10 may include the seventh transistor T7 and the eighth transistor T8. When the driving transistor T0 is a P-type transistor, the seventh transistor T7 may be used to transmit the data signal voltage "vdata" of the data signal line "VDATA" to the first terminal of the driving transistor T0. When the driving transistor T0 is an N-type transistor, the seventh transistor T7 may be used to transmit the data signal voltage "vdata" of the data signal line "VDATA" to the second terminal of the driving transistor T0.

Further, referring to FIG. 1 and FIG. 2-FIG. 5, the light-emitting control module 20 may include a ninth transistor T9 and a tenth transistor T10.

The gate of the ninth transistor T9 may be electrically connected to the light-emitting control signal terminal "EMIT". The first terminal of the ninth transistor T9 may be electrically connected to the first power source voltage signal line "PVDD"; and the second terminal of the ninth transistor T9 may be electrically connected to the first terminal of the driving transistor T0.

The gate of the tenth transistor T10 may be electrically connected to a light-emitting control signal terminal "EMIT"; the first terminal of the tenth transistor T10 and the second terminal of the driving transistor T0 may be electrically connected; and a second terminal of the tenth transistor T10 may be electrically connected to the first terminal of the light-emitting device LE.

The current-stage light-emitting signal "emit" may be transmitted to the gate of the ninth transistor T9 and the gate of the tenth transistor T10 through the light-emitting control signal terminal "EMIT", respectively.

Further, referring to FIG. 1 and FIG. 2 to FIG. 5, the pixel circuit may include a capacitive device C.

When the driving transistor T0 is a P-type transistor, the first plate of the capacitive device C may be electrically connected to the first power voltage signal line "PVDD"; and the second plate of the capacitive device C may be electrically connected to the gate of the driving transistor T0. When the driving transistor T0 is an N-type transistor, the first plate of the capacitive device C and the second terminal of the driving transistor T0 may be electrically connected; and the second plate of the capacitive device C may be electrically connected to the gate of the driving transistor T0.

In one embodiment, the capacitive device C may have a holding function to maintain the gate voltage of the driving transistor T0.

In the pixel circuit, the light-emitting device LE may be a micro light-emitting diode or a sub-millimeter light-emitting diode, and the second terminal of the light-emitting device LE may be electrically connected to the second power source voltage signal line "PVEE".

Micro LEDs are LEDs with a die size between approximately 1 micron and 100 microns. Micro LEDs may be able to achieve a display panel of approximately 0.05 mm or smaller pixel size. Micro LEDs may have low power consumption, acceptable material stability and no image residue.

Sub-millimeter light-emitting diodes, also known as mini-LEDs, are LEDs having a die size between approximately 100 microns and 1000 microns. The mini-LEDs may have a high yield, a profiled cut feature, and better color rendering, etc. When applied to a display panel, the mini-LEDs may be able to provide a finer HDR (High Dynamic Range) partition for the display panel.

In the pixel circuit, when the driving transistor T0 is an N-type transistor, the first terminal of the driving transistor T0 may be the drain of the driving transistor T0; and the second terminal of the driving transistor T0 may be the source of the driving transistor T0. When the driving transistor T0 is a P-type transistor, the first terminal of the driving transistor T0 may be the source of the driving transistor T0, and the second terminal of the driving transistor T0 may be the drain of the driving transistor T0.

Figure 6:
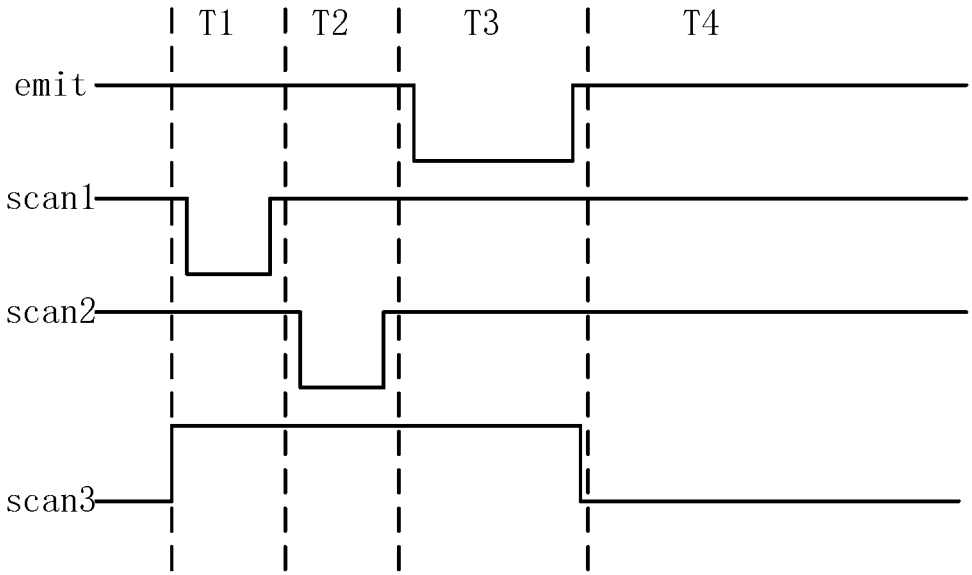
FIG. 6 illustrates an exemplary time sequence diagram of a pixel driving method consistent with various disclosed embodiments.
Figure 9:
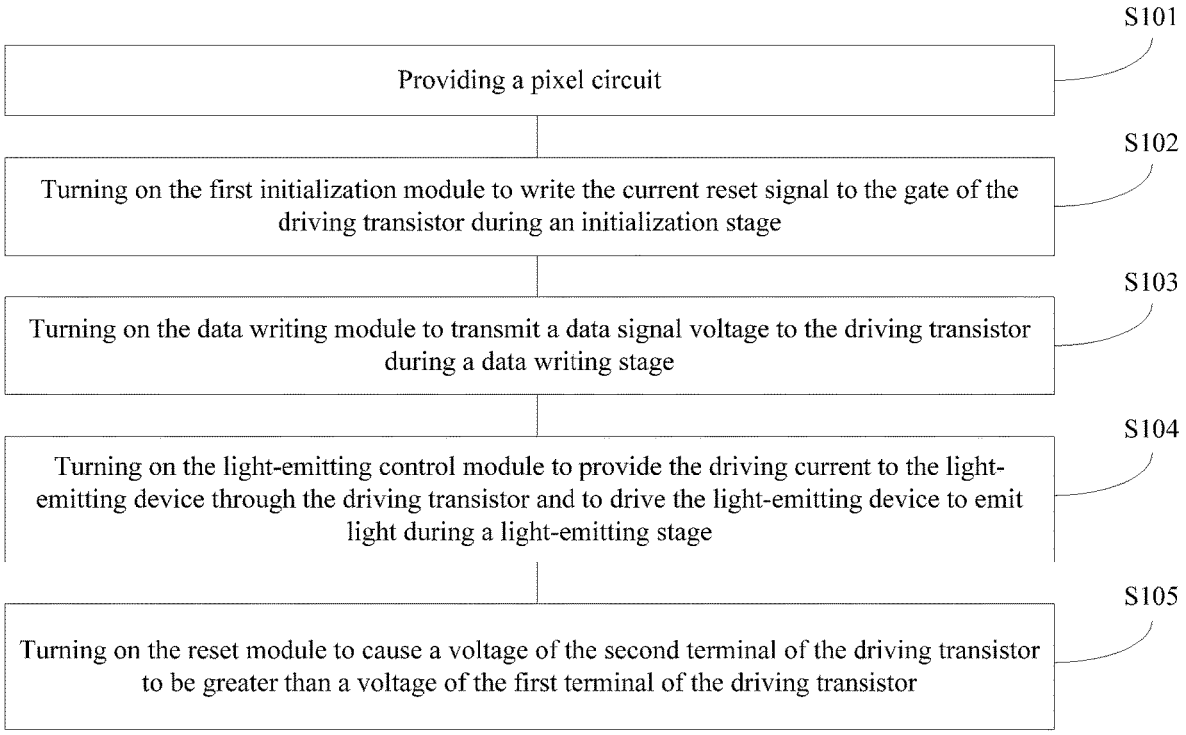
FIG. 9 illustrates an exemplary method for driving a pixel circuit consistent with various disclosed embodiments.

The present disclosure also provides a method for driving a pixel circuit. FIG. 9 illustrates an exemplary method for driving a pixel circuit consistent with various disclosed embodiment. The method may be used to drive a disclosed pixel circuit, or other appropriate pixel circuit. FIG. 6 illustrates a time sequence diagram of an exemplary method for driving a pixel circuit consistent with various disclosed embodiments. For illustrative purposes, the method for driving the disclosed pixel circuit is described.

As shown in FIG. 1, FIG. 2, FIG. 4, FIG.6 and FIG. 9, the method may include providing a disclosed pixel circuit (S101) and turning on the first initialization module 30 of the pixel circuit to write the first initialization voltage "ref1" to the gate of the driving transistor T0 in an initialization phase T1 (S102). In the initialization phase T1, the scan signal "scan1" of the previous-stage may an enable signal; the current scan line signal "scan2" may be a non-enable signal; the current-stage light-emitting signal "emit" may be a non-enable signal; and the current-stage reset signal "scan3" may be a non-enable signal.

The method may also include turning on the data writing module 10 to transmit the data signal voltage "vdata" to the driving transistor T0 in a data writing phase T2 (S103). In the data writing phase T2, the previous-stage scan signal "scan1" may be a non-enable signal; the current-stage scan signal "scan2" may be an enable signal; the current-stage light-emitting signal "emit" may be a non-enable signal; and the current-stage reset signal "scan3" may be a non-enable signal.

Further, the method may include turning on the light-emitting control module 20 to supply a driving current to the light-emitting device LE through the driving transistor T0 to drive the light-emitting device LE to emit light in a light-emitting phase T3 (S104). In the light-emitting phase T3, the previous-stage scan signal "scan1" may be a non-enable signal; the current-stage scan line signal "scan2" may be a non-enable signal; the current-stage light-emitting signal "emit" may be an enable signal; and the current-stage reset signal "scan3" may be a non-enable signal.

Further, the method may include turning on the reset module 50 to cause the voltage of the second terminal of the driving transistor T0 to be greater than or equal to the voltage of the first terminal of the driving transistor T0 in a reset phase T4. In the reset phase T4, the previous-stage scan signal "scan1" may be a non-enable signal; the current-stage scan signal "scan2" may be a non-enable signal; the current-stage light-emitting signal "emit" may be a non-enable signal; and the current-stage reset signal "scan3" may be an enable signal.

The second initialization module 40 may be turned on in response to the enable signal of the previous-stage scan signal "scan1" of in the initialization phase T1 or may be turned on in response to the enable signal of the current-stage scan signal "scan2" in the data writing phase T2. The second initialization module 40 may write the second initialization voltage "ref2" to the first terminal of the light-emitting device LE.

In the method for driving the pixel circuit, the gate of the driving transistor T0 may be initialized in the initialization phase T1. At the data writing phase T2, the data signal voltage "vdata" may be written to the pixel circuit. In the light-emitting phase T3, the light-emitting device LE may emit light in response to the driving current. When the driving transistor T0 generates the driving current, the voltage of the first terminal of the driving transistor T0 may be greater than the voltage of the second terminal of the driving transistor T0. Under such a condition, the electrons in the driving transistor T0 may move from the second terminal to the first terminal. In the reset phase T4, the voltage of the second terminal of the driving transistor T0 may be made larger than the voltage of the first terminal to cause the characteristic of the driving transistor T0 to be shifted an opposite direction. Thus, the technical effect of repairing the characteristic drift of the driving transistor T0 may be realized. In some embodiments, the voltage of the second terminal of the driving transistor T0 may be made equal to the voltage of the first terminal to cause the driving transistor T0 to be no longer at a bias state. Thus, the characteristic drift and the heat generation, etc., of the driving transistor T0 may be reduced. The first terminal of the light-emitting device LE may be initialized during the initialization phase T1, or during the data writing phase T2.

The N-type transistor is often turned on under the control of the high-level signal, and is turned off under the control of the low-level signal; and the P-type transistor is often turned on under the control of the low-level signal, and is turned off under the control of the high-level signal.

In one embodiment, for illustrative purposes, that each pixel in the pixel circuit is a P-type transistor is used as an example to describe the driving method of the pixel circuit. Under such a condition, the enable signal is a low-level signal, and the non-enable signal is a high-level signal. In some embodiments, when the transistors in the pixel circuit are N-type transistors, the enable signal is a high-level signal, and the non-enable signal is a low-level signal.

Figure 7:
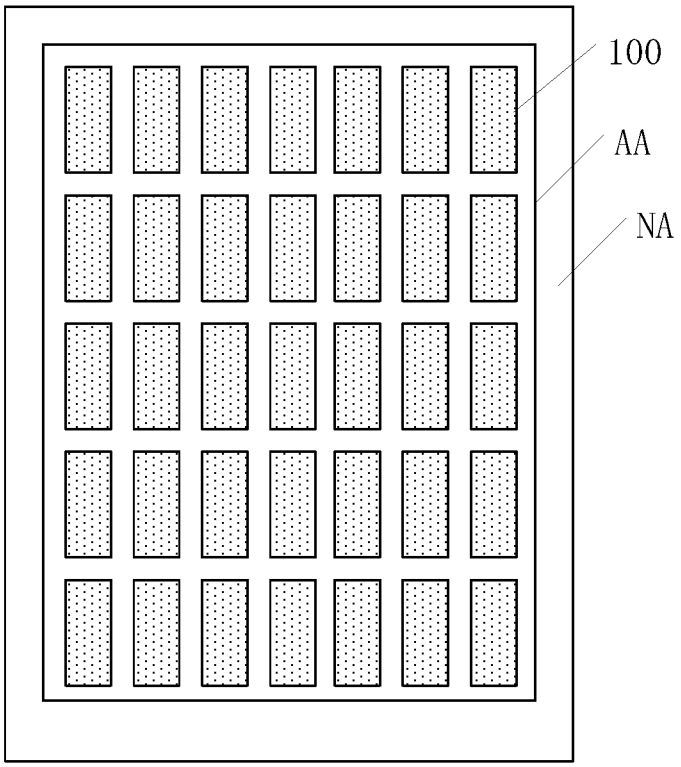
FIG. 7 illustrates an exemplary display panel consistent with various disclosed embodiments.

Further, the present disclosure provides a display panel. The display panel may include a plurality of the disclosed pixel circuits or other appropriate pixel circuits. FIG. 7 illustrates an exemplary display panel consistent with various disclosed embodiments.

As shown in FIG. 7, the display panel may include a display area AA and a non-display area NA. The display area AA may include a plurality of pixel circuits 100. The pixel circuits 100 may be any one of the disclosed pixel circuits described previously.

For illustrative purposes, the pixel circuits 100 in FIG. 7 are distributed as an array in the display area AA. The distribution of the pixel circuits 100 in the display area AA may be various and is not specifically limited in the present disclosure.

Because the display panel may include the disclosed pixel circuits, the display "mura" and residual images issues may be reduced; and the display quality of may be improved.

Figure 8:
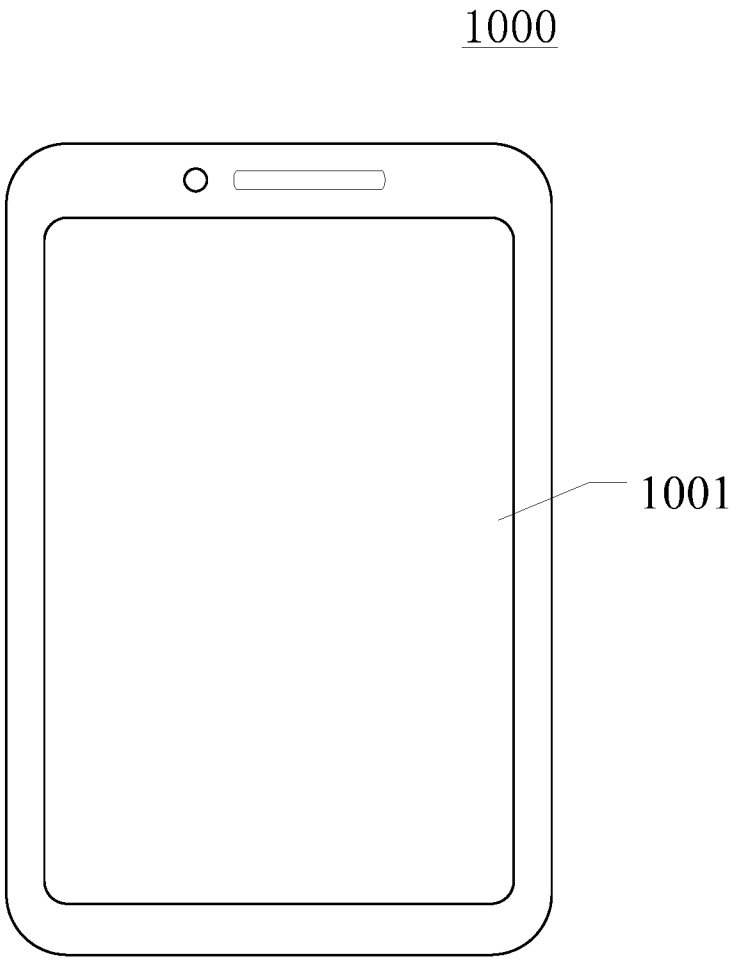
FIG. 8 illustrates an exemplary display apparatus consistent with various disclosed embodiments.

The present disclosure also provides a display apparatus. The display apparatus may include at least one disclosed display panel or other display panels. FIG. 8 illustrates an exemplary display apparatus consistent with various disclosed embodiments.

As shown in FIG. 8, the display apparatus 1000 may include a display panel 1001. The display panel 1001 may include one of the disclosed panels.

For illustrative purposes, a mobile phone is used as an example to describe the display apparatus 1000. In some embodiments, the display apparatus may be any display apparatus having a display function, such as a computer, a television, or in-vehicle display apparatus, etc.

The display apparatus may have at least the beneficial effects of the disclosed display panel. The details of the display apparatus may be referred to the detailed description of the display panels and the pixel circuits.

The disclosed pixel circuit, the method for driving pixel circuit, the display panel and the display apparatus may achieve at least the following beneficial effects.

To prevent the accumulation of the electrons in the driving transistor caused by a long time movement along a certain direction and cause the shift of the characteristics, a reset module may be disposed in the pixel circuit, and an enable signal of the current-stage reset signal may appear after the enable signal of the current-stage light-emitting signal. In another word, after the enable signal of the light-emitting signal controls the light-emitting of the light-emitting device, the enable signal of the reset signal may control the reset module to be in operation. The reset module may be responsive to the enable signal of the current-stage reset signal such that the voltage of the second terminal of the driving transistor may be greater than or equal to the voltage of the first terminal of the driving transistor.

When the voltage of the second terminal of the driving transistor is greater than the voltage of the first terminal of the driving transistor, the electrons in the driving transistor may be moved from the first terminal to the second terminal; and the moving direction of the electrons may be opposite to the moving direction of the electrons when the driving transistor generates the driving current. Therefore, the characteristics of the driving transistor may be oppositely shifted. Thus, the technical effect of repairing the characteristic drift of the driving transistor may be achieved.

When the voltage of the second terminal of the driving transistor is equal to the voltage of the first terminal of the driving transistor, there may be no voltage difference between the first terminal and the second terminal of the driving transistor. Thus, there may be no current flow. During the time period when the reset module is in operation, the driving transistor may be no longer at a bias state. Thus, problems, such as characteristic drift and heat generation of the driving transistor, may be reduced.

The description of the disclosed embodiments is provided to illustrate the present disclosure to those skilled in the art. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A pixel circuit, comprising:

a data writing module, a driving transistor, a light-emitting control module, a light-emitting device, a first initialization module, a second initialization module, and a reset module, wherein:

the data writing module is configured to transmit a data signal voltage to the driving transistor in response to a current-stage scan signal;

the driving transistor is configured to generates a driving current according to the data signal voltage transmitted from the data writing module;

a voltage of a first terminal of the driving transistor is greater than a voltage of a second terminal of the driving transistor;

the light-emitting control module is coupled between a first power source voltage signal terminal and a first terminal of the light-emitting device and configured to provide a driving current to the light-emitting device through the driving transistor in response to a current-stage light-emitting signal;

the light-emitting device is configured to emit light in response to the driving current generated by the driving transistor;

the first initialization module is electrically connected to a gate of the driving transistor and configured to provide a first initialization voltage to the gate of the driving transistor in response to a previous-stage scan signal;

the second initialization module is electrically connected to the first terminal of the light-emitting device and configured to provide a second initialization voltage to the first terminal of the light-emitting device;

the reset module is configured to cause a voltage of the second terminal of the driving transistor to be greater than or equal to a voltage of the first terminal of the driving transistor in the reset module is configured to cause a voltage of the second terminal of the driving transistor to be greater than or equal to a voltage of the first terminal of the driving transistor in response to an enable signal of a current-stage reset signal, the enable signal of the current-stage reset signal appearing after an enable signal of the current-stage light-emitting signal; and the reset module is further configured to cause the second terminal of the driving transistor to be electrically connected to the first terminal of the driving transistor in response to the current-stage reset signal.

2. The pixel circuit according to claim 1, wherein:

the reset module is configured to cause the voltage of the second terminal of the driving transistor to be greater than the voltage of the first terminal of the driving transistor in response to the current-stage reset signal.

3. The pixel circuit according to claim 2, wherein the reset module comprises:

a third transistor; and a fourth transistor, wherein:

a gate of the third transistor is electrically connected to a third control signal terminal;

a first terminal of the third transistor is electrically connected to a reset voltage terminal;

a second terminal of the third transistor is electrically connected to the gate of the driving transistor;

when the driving transistor is a P-type transistor, a gate of the fourth transistor is electrically connected to the third control signal terminal, a first terminal of the fourth transistor is electrically connected to the reset voltage terminal, a second terminal of the fourth transistor is electrically connected to the second terminal of the driving transistor, and a reset voltage of the reset voltage terminal is greater than a voltage of the first terminal of the driving transistor;

when the driving transistor is an N-type transistor, a gate of the fourth transistor is electrically connected to the third control signal terminal, a first terminal of the fourth transistor is electrically connected to the reset voltage terminal, a second terminal of the fourth transistor is electrically connected to the first terminal of the driving transistor, and a reset voltage of the reset voltage terminal is greater than a voltage of the second terminal of the driving transistor; and the current-stage reset signal is transmitted to the gate of the third transistor and the gate of the fourth transistor through the third control signal terminal, respectively.

4. The pixel circuit according to claim 3, wherein:

the first terminal of the driving transistor is configured to receive a first power source voltage transmitted by a first power source signal line;

when the driving transistor is a P-type transistor, the reset voltage is greater than the first power source voltage; and when the driving transistor is an N-type transistor, the reset voltage is greater than a voltage of a second terminal of the light-emitting device.

5. The pixel circuit according to claim 1, wherein the first initialization module comprises:

a fifth transistor, wherein:

a gate of the fifth transistor is electrically connected to a first control signal terminal;

a first terminal of the fifth transistor is electrically connected to a first initialization voltage terminal;

a second terminal of the fifth transistor is electrically connected to the gate of the driving transistor; and a previous-stage scan signal is transmitted to the gate of the fifth transistor through the first control signal terminal.

6. The pixel circuit according to claim 1, wherein the second initialization terminal comprises:

a sixth transistor, wherein:

a gate of the sixth transistor is electrically connected to one of the first control signal terminal and a second control signal terminal;

a first terminal of the sixth transistor is electrically connected to a second initialization voltage terminal;

a second terminal of the sixth transistor is electrically connected to the first terminal of the light-emitting device; and a previous-stage scan signal is transmitted to the gate of the sixth transistor through one of the first control signal terminal and the second terminal electrically connected to the gate of the sixth transistor.

7. The pixel circuit according to claim 1, wherein the data writing module comprises:

a seventh transistor; and an eighth transistor, wherein:

when the driving transistor is a P-type transistor, a gate of the seventh transistor is electrically connected to a second control signal terminal, a first terminal of the seventh transistor is electrically connected to the gate of the driving transistor, a second terminal of the seventh transistor is electrically connected to the second terminal of the driving transistor, a gate of the eighth transistor is electrically connected to the third control signal terminal, a first terminal of the eighth transistor is electrically connected to a data signal line, and a second terminal of the eighth transistor is electrically connected to the first terminal of the driving transistor;

when the driving transistor is an N-type transistor, a gate of the seventh transistor is electrically connected to a second control signal terminal, a first terminal of the seventh transistor is electrically connected to the gate of the driving transistor, a second terminal of the seventh transistor is electrically connected to the first terminal of the driving transistor, a gate of the eighth transistor is electrically connected to the third control signal terminal, a first terminal of the eighth transistor is electrically connected to a data signal line, a second terminal of the eighth transistor is electrically connected to the second terminal of the driving transistor; and the current-stage scan signal is transmitted to the gate of the seventh transistor and the gate of the eighth transistor through the second control signal terminal, respectively.

8. The pixel circuit according to claim 1, wherein the light-emitting control module comprises:

a ninth transistor; and a tenth transistor, wherein:

a gate of the ninth transistor is electrically connected to a light-emitting control terminal, a first terminal of the ninth transistor is electrically connected to the first power source signal line;

a second terminal of the ninth transistor is electrically connected to the first terminal of the driving transistor;

a gate of the tenth transistor is electrically connected to the light-emitting control terminal;

a first terminal of the tenth transistor is electrically connected to the second terminal of the driving transistor;

a second terminal of the tenth transistor is electrically connected to the first terminal of the light-emitting device; and the current-stage light-emitting signal is transmitted to the gate of the ninth transistor and the gate of the tenth transistor through the light-emitting control signal terminal, respectively.

9. The pixel circuit according to claim 1, further comprising:

a capacitive device, wherein:

when the driving transistor is a P-type transistor, a first plate of the capacitive device is electrically connected to the first power source signal line, and a second plate of the capacitive device is electrically connected to the gate of the driving transistor; and when the driving transistor is an N-type transistor, a first plate of the capacitive device is electrically connected to the second terminal of the driving transistor, and a second plate of the capacitive device is electrically connected to the gate of the driving transistor.

10. The pixel circuit according to claim 1, wherein:

the light-emitting device is one of a micro light-emitting diode and a submillimeter light-emitting diode; and a second terminal of the light-emitting device is connected to a second power source signal line.

11. The pixel circuit according to claim 1, wherein:

when the driving transistor is an N-type transistor, a first terminal of the driving transistor is a drain of the driving transistor and a second terminal of the driving transistor is a source of the driving transistor; and when the driving transistor is a P-type transistor, a first terminal of the driving transistor is a source of the driving transistor and a second terminal of the driving transistor is a drain of the driving transistor.

12. A display panel comprising a plurality of pixel circuits according to claim 1.

13. A pixel circuit, comprising:

a data writing module, a driving transistor, a light-emitting control module, a light-emitting device, a first initialization module, a second initialization module, and a reset module, wherein:

the data writing module is configured to transmit a data signal voltage to the driving transistor in response to a current-stage scan signal;

the driving transistor is configured to generates a driving current according to the data signal voltage transmitted from the data writing module;

a voltage of a first terminal of the driving transistor is greater than a voltage of a second terminal of the driving transistor;

the light-emitting control module is coupled between a first power source voltage signal terminal and a first terminal of the light-emitting device and configured to provide a driving current to the light-emitting device through the driving transistor in response to a current-stage light-emitting signal;

the light-emitting device is configured to emit light in response to the driving current generated by the driving transistor;

the first initialization module is electrically connected to a gate of the driving transistor and configured to provide a first initialization voltage to the gate of the driving transistor in response to a previous-stage scan signal;

the second initialization module is electrically connected to the first terminal of the light-emitting device and configured to provide a second initialization voltage to the first terminal of the light-emitting device;

the reset module is configured to cause a voltage of the second terminal of the driving transistor to be greater than or equal to a voltage of the first terminal of the driving transistor in response to a current-stage reset signal;

an enable signal of the current-stage reset signal appears after an enable signal of the current-stage light-emitting signal; and the reset module is configured to cause the second terminal of the driving transistor to be electrically connected to the first terminal of the driving transistor in response to the current-stage reset signal.

14. The pixel circuit according to claim 13, wherein the reset module comprises:

a first transistor; and a second transistor, wherein:

when the driving transistor is a P-type transistor, a gate of the first transistor is electrically connected to a third control signal terminal, a first terminal of the first transistor is electrically connected to the gate of the driving transistor, and a second terminal of the first transistor is electrically connected to the first terminal of the driving transistor, a gate of the second transistor is electrically connected to the third control signal terminal, a first terminal of the second transistor is electrically connected to the first terminal of the driving transistor, a second terminal of the second transistor is electrically connected to the second terminal of the driving transistor;

when the driving transistor is an N-type transistor, a gate of the first transistor is electrically connected to the third control signal terminal, a first terminal of the first transistor is electrically connected to the gate of the driving transistor, a second terminal of the first transistor is electrically connected to the second terminal of the driving transistor, a gate of the second transistor is electrically connected to the third control signal terminal, a first terminal of the second transistor is electrically connected to the first terminal of the driving transistor, a second terminal of the second transistor is electrically connected to the second terminal of the driving transistor; and the current-stage reset signal is transmitted to the gate of the first transistor and the gate of the second transistor through the third control signal terminal, respectively.

15. The pixel circuit according to claim 13, wherein the first initialization module comprises:

a fifth transistor, wherein:

a gate of the fifth transistor is electrically connected to a first control signal terminal;

a first terminal of the fifth transistor is electrically connected to a first initialization voltage terminal;

a second terminal of the fifth transistor is electrically connected to the gate of the driving transistor; and a previous-stage scan signal is transmitted to the gate of the fifth transistor through the first control signal terminal.

16. The pixel circuit according to claim 13, wherein the second initialization terminal comprises:

a sixth transistor, wherein:

a gate of the sixth transistor is electrically connected to one of the first control signal terminal and a second control signal terminal;

a first terminal of the sixth transistor is electrically connected to a second initialization voltage terminal;

a second terminal of the sixth transistor is electrically connected to the first terminal of the light-emitting device; and a previous-stage scan signal is transmitted to the gate of the sixth transistor through one of the first control signal terminal and the second terminal electrically connected to the gate of the sixth transistor.

17. A method for driving a pixel circuit, comprising:

providing a pixel circuit, including a data writing module, a driving transistor, a light-emitting control module, a light-emitting device, a first initialization module, a second initialization module, and a reset module, wherein:

the data writing module is configured to transmit a data signal voltage to the driving transistor in response to a current-stage scan signal;

the driving transistor is configured to generates a driving current according to the data signal voltage transmitted from the data writing module;

a voltage of a first terminal of the driving transistor is greater than a voltage of a second terminal of the driving transistor;

the light-emitting control module is coupled between a first power source voltage signal terminal and a first terminal of the light-emitting device and configured to provide a driving current to the light-emitting device through the driving transistor in response to a current-stage light-emitting signal;

the light-emitting device is configured to emit light in response to the driving current generated by the driving transistor;

the first initialization module is electrically connected to a gate of the driving transistor and configured to provide a first initialization voltage to the gate of the driving transistor in response to a previous-stage scan signal;

the second initialization module is electrically connected to the first terminal of the light-emitting device and configured to provide a second initialization voltage to the first terminal of the light-emitting device;

the reset module is configured to cause a voltage of the second terminal of the driving transistor to be greater than or equal to a voltage of the first terminal of the driving transistor in response to a current-stage reset signal; and an enable signal of the current-stage reset signal appears after an enable signal of the current-stage light-emitting signal;

turning on the first initialization module to write the current-stage reset signal to the gate of the driving transistor during an initialization phase when the previous-stage scan signal is an enable signal, the current-stage scan signal is a non-enable signal, the current-stage light-emitting signal is a non-enable signal, and the current-stage reset signal is a non-enable signal;

turning on the data writing module to transmit a data signal voltage to the driving transistor during a data writing phase when the previous-stage scan signal is a non-enable signal, the current-stage scan signal is an enable signal, the current-stage light-emitting signal is a non-enable signal, and the current-stage reset signal is a non-enable signal;

turning on the light-emitting control module to provide the driving current to the light-emitting device through the driving transistor and to drive the light-emitting device to emit light during a light-emitting phase when the previous-stage scan signal is an enable signal, the current-stage scan signal is a non-enable signal, the current-stage light-emitting signal is an enable signal, and the current-stage reset signal is a non-enable signal; and turning on the reset module to cause a voltage of the second terminal of the driving transistor to be greater than or equal to a voltage of the first terminal of the driving transistor during a reset phase when the previous-stage scan signal is a non-enable signal, the current-stage scan signal is a non-enable signal, the current-stage light-emitting signal is a non-enable signal, and the current-stage reset signal is an enable signal.

18. The method according to claim 17, wherein:

the second initialization module is turned on in response to an enable signal of the previous-stage scan signal during the initialization phase.

19. The method according to claim 17, wherein:

the second initialization module is turned on in repose to an enable signal of the current-stage scan signal during the initialization phase to write a second initialization voltage to the firstterminal of the light-emitting device.

20. The method according to claim 17, wherein:

the reset module is configured to connect the second terminal of the driving transistor to the first terminal of the driving transistor in response to the current-stage reset signal.

* * * * *